US005186130A

United States Patent [19]

Melchior

[11] Patent Number: 5,186,130

[45] Date of Patent: Feb. 16, 1993

[54] CAMSHAFT CONTROL DEVICE

[76] Inventor: Jean F. Melchior, 126 Bld du Montparnasse, 75 014 Paris, France

[21] Appl. No.: 704,047

[22] Filed: May 22, 1991

[30] Foreign Application Priority Data

Jun. 8, 1990 [FR] France ..... 90 07161

[51] Int. Cl.[5] ..... F16C 32/06; F01L 1/04

[52] U.S. Cl. ..... 123/90.35; 123/90.36; 123/90.39; 123/90.5; 74/559; 74/569

[58] Field of Search ..... 123/90.33, 90.35, 90.36, 123/90.39, 90.41, 90.42, 90.48, 90.5; 74/519, 559, 569

[56] References Cited

U.S. PATENT DOCUMENTS

| | | | |
|---|---|---|---|
| 1,565,223 | 12/1925 | Church . | |
| 2,508,557 | 6/1950 | Wood . | |
| 3,314,303 | 4/1967 | Maat | 123/90.5 |
| 3,822,683 | 7/1974 | Clouse . | |
| 4,204,814 | 5/1980 | Matzen | 74/569 |
| 4,335,685 | 6/1982 | Clouse | 123/90.5 |
| 4,708,102 | 11/1987 | Schmid | 123/90.35 |
| 4,909,197 | 3/1990 | Perr | 123/90.48 |
| 5,010,856 | 4/1991 | Ojala | 123/90.41 |
| 5,127,374 | 7/1992 | Morel, Jr. et al. | 123/90.35 |

FOREIGN PATENT DOCUMENTS

| | | | |
|---|---|---|---|
| 232324 | 3/1964 | Austria . | |
| 2340074 | 2/1975 | Fed. Rep. of Germany . | |
| 2920075 | 11/1980 | Fed. Rep. of Germany | 123/90.35 |
| 298610 | 12/1990 | Japan | 123/90.35 |
| 298611 | 12/1990 | Japan | 123/90.35 |
| 1109378 | 4/1968 | United Kingdom . | |

*Primary Examiner*—E. Rollins Cross
*Assistant Examiner*—Weilun Lo
*Attorney, Agent, or Firm*—Larson and Taylor

[57] ABSTRACT

A control device includes a camshaft and a roller resting on a tappet or rocker arm. The roller swivels about itself in a recess which is arranged in the leading part of the tappet or rocker arm and which is fed with pressurized oil. This recess is bordered by a circular semi-cylindrical wall and by the inside walls of two flat lateral flanges.

15 Claims, 7 Drawing Sheets

CAMSHAFT CONTROL DEVICE

Figure 1:
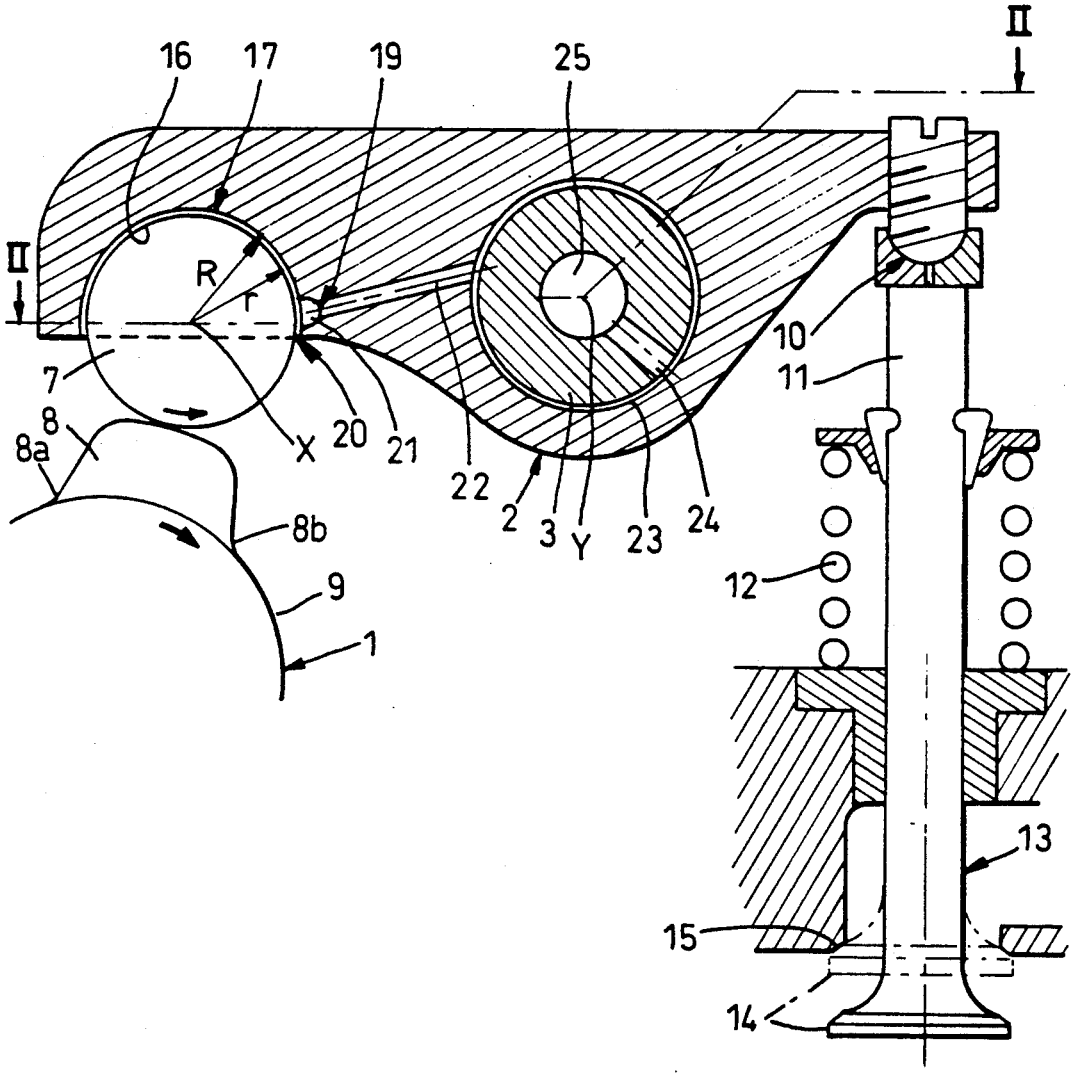

This invention relates to camshaft control devices with roller force transmitting means allowing the transmission of an alternating motion, which is transmitted through the cam of a camshaft which rotates in a same direction around its axis, to a mechanical member which presents an alternating motion and which is maintained resting on said cam with elastic return means. These control devices are made so as to transmit the alternating motion to the mechanical member, either through a push rod bearing said roller and directly cooperating with said mechanical member (overhead camshaft control) or, indirectly, through a rocker arm which oscillates around an axis and includes a leading part bearing said roller and cooperating with the camshaft cam, and a led part which cooperates with said mechanical member. The invention relates more particularly to control devices whose roller force transmitting means are heavily mechanically loaded, that is to say able to transmit important forces so as to ensure a very quick and high rise of the mechanical member.

The invention relates more particularly, but not exclusively, to 2-stroke engines with loop scavenging through the cylinder head as exclusively controlled by valves so that these may be driven. In order to compensate for the low section which is offered by a valve for the engine fluid flow, if this section is compared with that of ports as arranged in the jacket of the or of each cylinder of the engine, it is indeed desirable to open the valves during the shortest possible time while giving the cam the 'steepest' possible profile. Moreover, it is known that this type of 2-stroke engine, with valve scavenging, generally has masks which partially close the passage which is freed by the intake valve when it is open, so as to reduce as much as possible air short-circuits between the intake and exhaust ports. The presence of these masks in turn reduces the valves's flow section. In order to compensate for this reduction in the peripheral section, one is led to increase, more than is usually done, the rise of these valves. The increase of this rise in a short time produces inertia problems which lead to overloading the roller force—transmitting means, and particularly the rocker arms, when the cylinder heads' geometry and the camshaft arrangement impose their presence.

In order to eliminate some of the drawbacks of said control devices wherein the roller is supported by a pin, it has been suggested in U.S. Pat. No. 4, 909,197, to suppress this pin and to arrange the roller so that it revolves about itself in a recess which is arranged in the leading part and bordered, on the one hand, by a semi-cylindrical wall, and, on the other hand, by the internal walls of two flat lateral flanges which are perpendicular to the semi-cylindrical wall axis. However, this document does not mention a pressurized oil intake in said recess, nor the degree of clearance between the roller and its housing, and moreover, describes a preferred embodiment, (FIG. 5 and claim 10) in which a ring-shaped groove arranged in the roller would prevent the building up of a notable oil pressure in said recess should pressurized oil be introduced in it.

The invention, the essential aim of which is to obviate the disadvantages of this state of the art, relates to a control device, through a camshaft and a roller, supported on a tappet or a rocker arm, for a mechanical member, having an alternating motion, notably for internal combustion engines, made up by force transmitting means from the camshaft cam to said mechanical member and including a leading part bearing an essentially cylindrical roller which cooperates with the camshaft cam and a led part which is rigid with the leading part and which cooperates with said mechanical member, said mechanical member moving between two extreme positions of which one corresponds to the maximum displacement of the roller on the cam, and the other is determined by a fixed stop on which abuts the mechanical member which is recalled by elastic return means when the roller cooperates with the downward part of the cam nose, the roller swivelling about itself (and not on a pin) in a recess which is arranged in the leading part and bordered on the one hand by a circular semi-cylindrical wall and on the other hand by the inside walls of two flat lateral flanges which are perpendicular to the semi-cylindrical wall axis, characterized in that:

an intake of pressurized oil communicating with an oil intake circuit, leads onto the recess semi-cylindrical inside wall, preferably near the outmost upstream generatrix of the semi-cylindrical wall, according to the rotating direction of the roller, and, the semi-cylindrical wall has a radius which is slightly above the roller's external radius whereas the inside walls of the lateral flanges are separated by a distance which is slightly above the roller width so as to leave between the roller and, on the one hand, the edges of the semi-cylindrical recess, and, on the other hand the flanges' inside walls, only an operating clearance which is small enough so that, in operation, the oil from said intake maintains a hydrodynamic oil film between the roller and the recess walls, and that the lateral leakage is reduced to a minimum.

In this context, 'essentially cylindrical roller' means a roller having the shape of a cylinder of revolution, with possibly a slight bulge.

Preferably, the flanges are integral with the leading part of the rocker arm.

As will be explained hereafter, such a control device effectively obviates the disadvantages of the usual camshaft and push rod or rocker arm control devices.

The invention will be explained more in detail with the help of the appended drawings.

Figure 2:
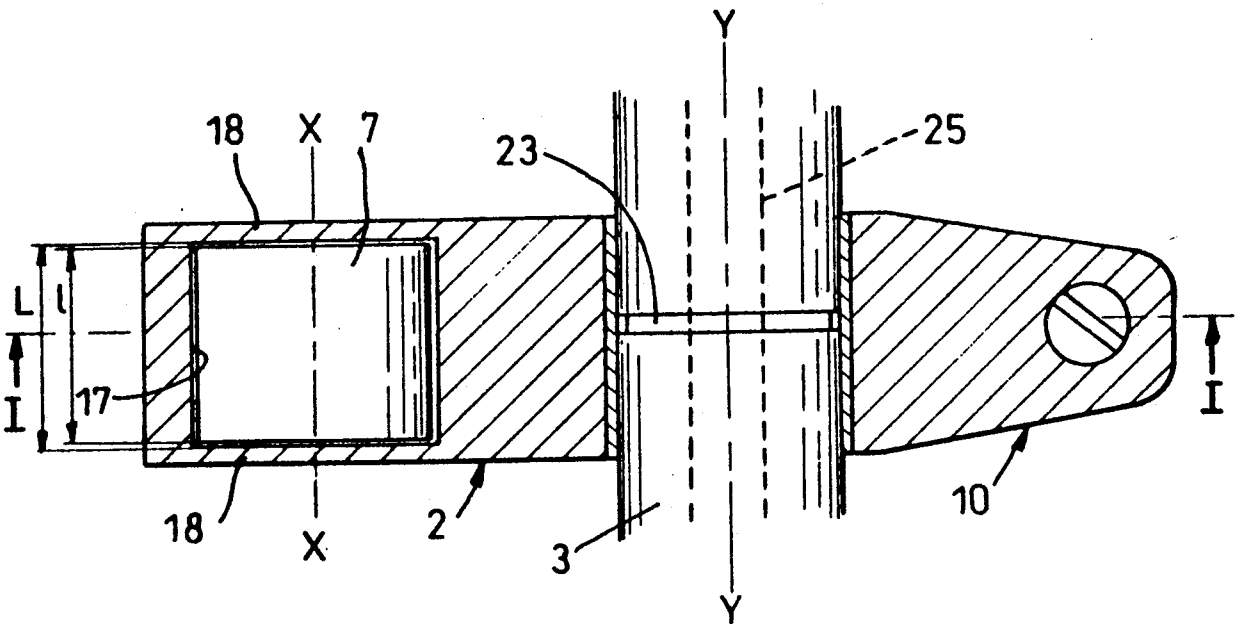

FIGS. 1 and 2 of the drawings represent a camshaft and rocker arm control device which is arranged according to the invention, in a partial section respectively according to lines I—I of FIG. 2 and II—II of FIG. 1.

FIGS. 3 to 6 each represent diagrammatically improvements to the embodiment of FIGS. 1 and 2, through extracts of FIG. 1 on a larger scale.

Figure 7:
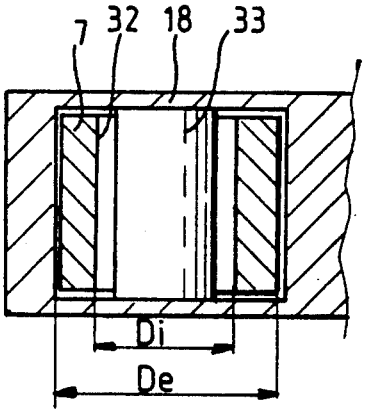

FIG. 7 represents a variation of part of FIG. 2.

Figure 8:
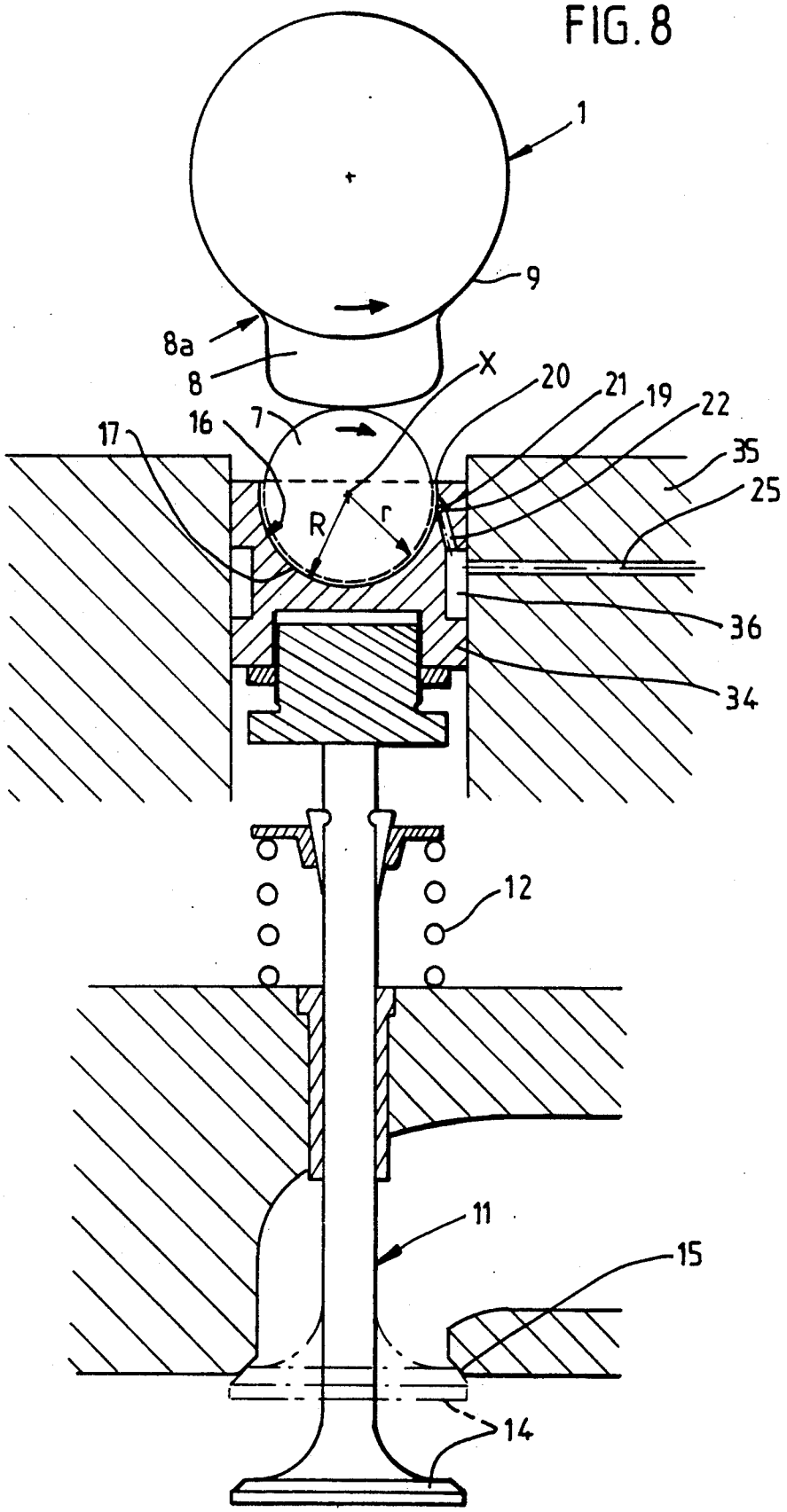

Finally, FIG. 8 represents diagrammatically a camshaft and tappet control device.

Before describing the invention, it seems useful to recall the state of the art as concerns the rocker arm control devices.

As shown in FIGS. 1 and 2, a known control device including a camshaft 1 and a rocker arm 2 generally comprises an axis 3 around which the rocker arm 2 rotates. At the leading end of rocker arm 2 swivels a roller 7, generally cylindrical in shape. This roller 7 rolls, preferably without sliding, on the nose 8 of a cam 9 which is rigid with the camshaft 1.

The led end of rocker arm 2 cooperates, generally through a spherical joint 10, with a mechanical member undergoing an alternating motion, which is generally straight or approximately straight, such as a valve rod 11, rocker arm rod, injection pump element or other.

When roller 7 engages the downward part 8*a* of the cam nose 8, the cohesion of the mechanical system, particularly the support of roller 7 on cam 9, is secured by a return spring 12 which may be mechanical, as diagrammatically represented in FIG. 1, or pneumatic until rod 11, or similar member, meets a stop. In the case where rod 11 is part of a valve 13 whose head 14 cooperates with a seat 15, this stop is generally made up by this seat 15. FIG. 1 shows in a solid line, the valve head 14 in an open position, and with a dot and dash line in a closed position, abutted on seat 15.

Moreover, when the nose 8 of cam 9 is retracted by the rotation of camshaft 1 (rotation diagrammatically represented by an arrow on FIG. 1), an operating clearance is arranged between roller 7 and cam 9 in such a manner that rod 11 may expand without stress. A clearance compensation ramp 8*b*, is arranged on cam 9, to allow contact with the smallest possible shock between the nose 8 of cam 9 and roller 7 in the following revolution, but generally this is not enough to totally suppress such a shock and the resulting noise or clinking.

According to the state of the art as defined by U.S. Pat. No. 4,909,197, roller 7 swivels about itself in a recess 16 which is arranged in the leading part of rocker arm 2 and bordered on the one hand with a circular semi-cylindrical wall 17, having an axis X—X which is parallel to the geometrical rotation axis Y—Y of rocker arm 2 around the latter's material axis 3 and on the other hand, by the inside walls of two flat lateral flanges 18 perpendicular to the axis X—X of the semi-cylindrical wall 17.

From this state of the art, the inventive control device which will first be described as applied to rocker arms, is identical with known devices, except for the assembling of roller 7 in the leading part of rocker arm 2, and it is essentially characterized as diagrammatically illustrated in FIGS. 1 and 2, in that:

a pressurized oil intake 19, communicating with an oil intake circuit, leads on to the semi-cylindrical wall 17 of recess 16, preferably near the outmost upstream generatrix 20 of the semi-cylindrical wall 17 according to roller 7's rotation direction (as diagrammatically represented with an arrow in FIG. 1); and the semi-cylindrical wall 17 has a radius R which is slightly greater than the outside radius 2 of roller 7 and the inside walls of lateral flanges 18 are separated by a distance L which is slightly greater than the width of roller 7, so as to leave between roller 7 and, on the one hand, the edges of semi-cylindrical recess 17 and, on the other hand the inside walls of flanges 18, only an operating clearance which is small enough in order that, in operation, the oil from intake 19 maintains a hydrodynamic oil film between roller 7 and the walls of recess 16 and that the lateral oil leakage is reduced to a minimum.

The rotation direction of the roller, as well as that of camshaft 1 will be chosen so that the outmost upstream generatrix 20 is as near rocker shaft 3 as possible.

Preferably, the flanges 18 are integral with the leading part of rocker arm 2, as diagrammatically shown in FIG. 2.

The inlet opening 19 of pressurized oil on the semi-cylindrical wall 17 is advantageously made up of a transverse groove 21 arranged along generatrix 20.

Preferably, said pressurized oil intake 19 is essentially made up of a canal 22 which is arranged in the body of rocker arm 2 and communicating with the oil feeding curcuit (not shown) through a peripheral groove 23 arranged in rocker shaft 3, a radial passage 24 arranged in rocker shaft 3 and a canal 25 drawn longitudinally in rocker shaft 3.

Figure 4:
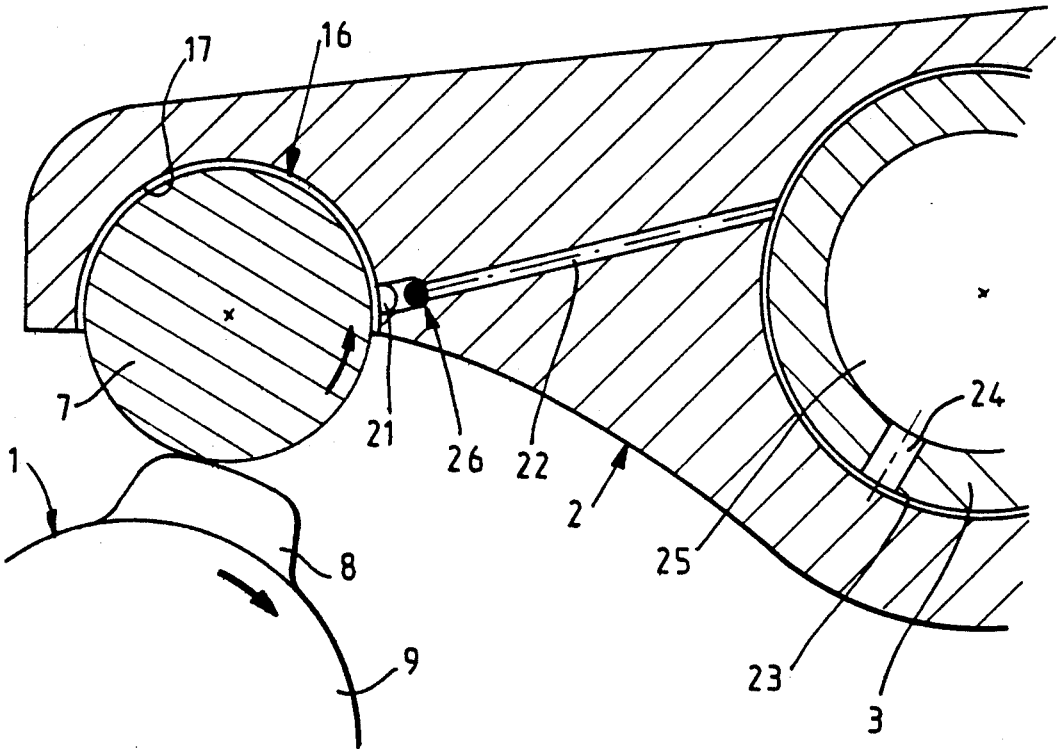

Canal 22 may end directly into groove 21 as represented in FIG. 1, or through unidirectional means, situated nearest to the ending on semi-cylindrical wall 17 and advantageously made up by a ball check valve 26 as represented in FIG. 4, which results in preventing the oil contained in recess 16 from being taken up again towards canal 25 in the case of variations in the oil feeding circuit pressure.

Figure 3:
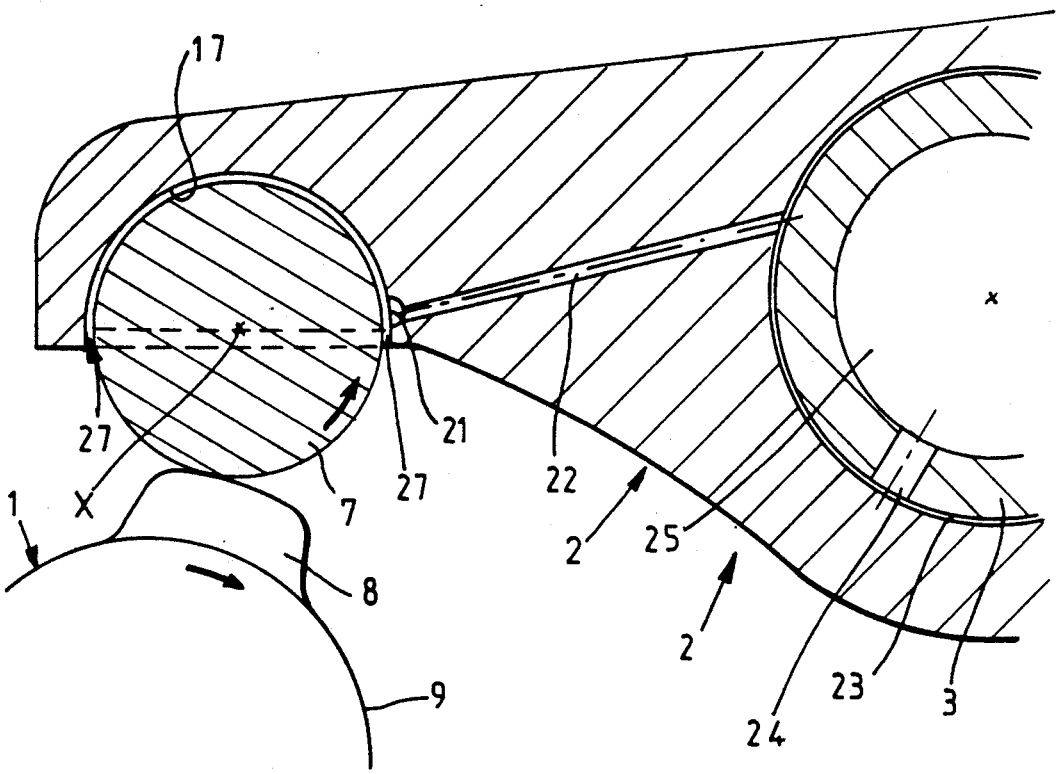

In order to automatically compensate for the clearance between roller 7 and cam 9, when the mechanical member 11 cooperating with the led part of rocker arm 2 is resting on its stop such as 15 (FIG. 1) under the influence of the elastic return means 12, roller 7 is used in recess 16 as a hydrostatic plunger in a cylinder to which pressurized oil is fed, this being done by advantageously lengthening, as represented in FIG. 3, the semi-cylindrical wall 17 having the axis X—X with two walls 27 which are parallel between themselves and with the axis X—X, and tangent, respectively to the ends of this semi-cylindrical wall 17.

Figure 5:
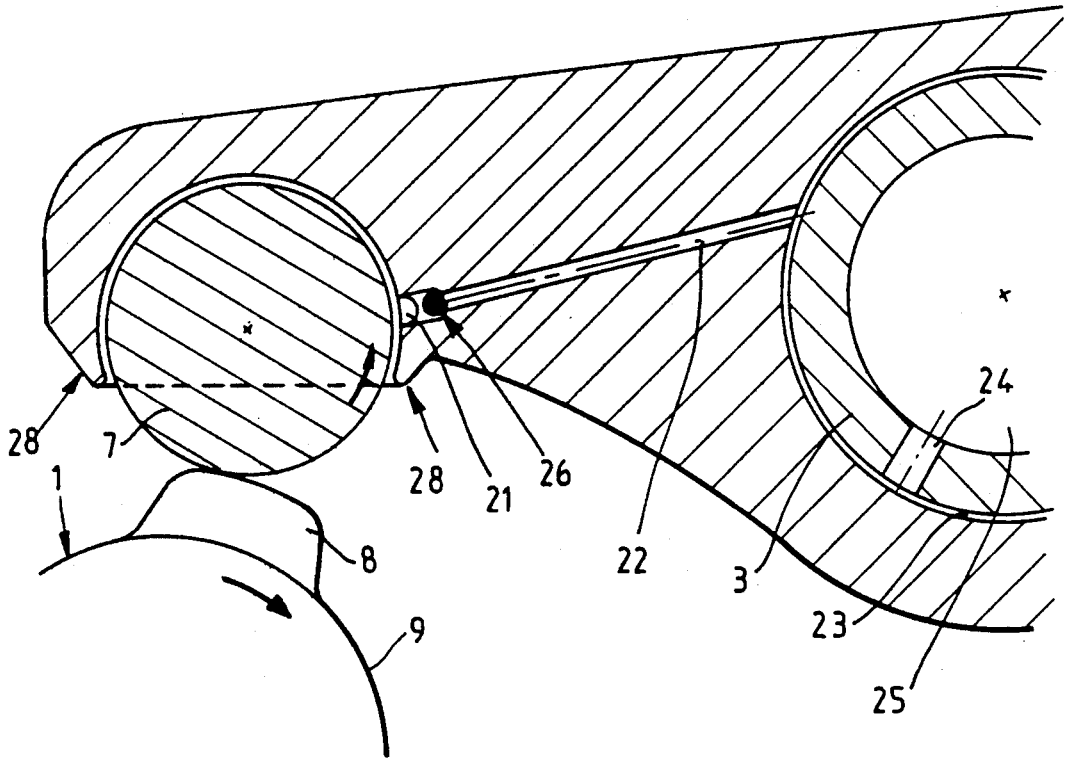

In order to maintain roller 7 in recess 16, the two ends of semi-cylindrical wall 17 (or the two parallel walls 27 in FIG. 3) may be lengthened, as represented in FIG. 5, respectively by tongues 28 whose ends are separated by a distance which is slightly inferior to the diameter 2r of roller 7 as represented diagrammatically in FIG. 5. The metal which makes up the leading part of rocker arm 2 et/or the thickness of tongues 28 will then be chosen so as to permit pushing roller 7 into recess 16 with enough pressure to elastically separate the ends of tongues 28, as the roller 7 goes by, these ends then elastically taking back their initial distance so as to confine roller 7 with a clearance.

Although the permanent feeding (in operation) of a hydrodynamic oil film in the interval bordered by the semi-cylindrical wall 17 and the cylindrical surface of roller 7, avoids wearing by preventing any metal-metal contact between roller 7 and the body of rocker arm 2, it may be advantageous to coat the surfaces in relative motion, or at least the semi-cylindrical wall 17 with an anti-friction coating, such as, for instance, a cupreous electrolytic deposit.

Figure 6:
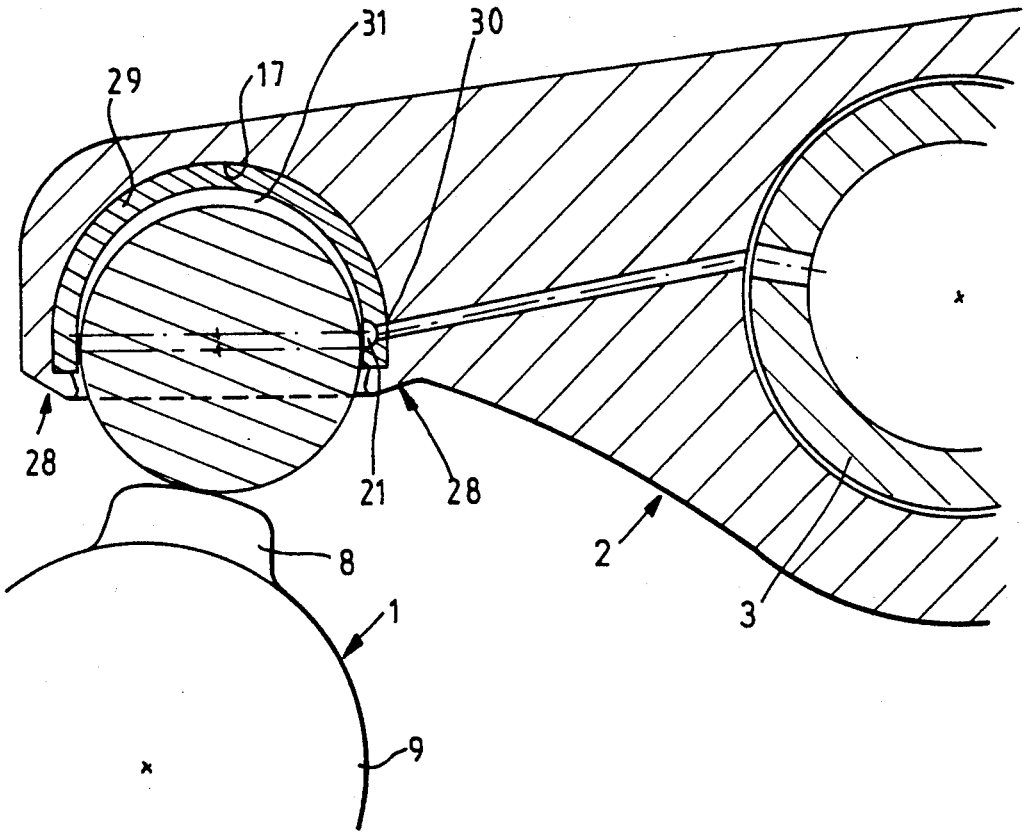

One may also, as shown in FIG. 6, interpose between roller 7 and rocker arm 2 a thin semi-cylindrical metal shell 29 made of an anti-friction material resting on the semi-cylindrical wall 17 of the recess shown by 16 in FIG. 1. An oil passage 30 through shell 29 must then be arranged and a groove 21 must be drawn in this shell to allow the feeding with oil of interval 31 between roller 7 and shell 29.

On the elevational representations in FIGS. 1 and 3 to 6, the roller 7 is solid. However, and as represented in section in FIG. 7, roller 7 is preferably hollow and pierced from end to end, with an axial hole 32 whose diameter, taking into account the material which makes up this roller 7, is sufficiently small to avoid any permanent warping of said roller 7, under the stress to which it is subjected in operation, but large enough to allow the elastic deformation of this roller 7 due to its contact with cam 9 so as to reduce the Hertz contact pressure. Preferably, the inside diameter Di of roller 7 is about 70% of its external diameter De. In a variation, a circular cylindrical spacer 33 having an external diameter inferior to the inside diameter Di of the hollow roller 7, is arranged along the axis X—X of the semi-cylindrical wall 17, rigid with the two lateral flanges 18, in which case the tongues 28 are no longer necessary.

One thus obtains a rocker arm control device which operates as follows. The oil which arrives in a pressurized form in groove 21 is distributed in recess 16 by rotating roller 7 and is maintained in that recess under an intermediate pressure which is a function of the feeding pressure and the leaking passage section as made up by the clearance between roller 7 and its housing walls. A hydrostatic oil film is thus maintained between roller 7 and its housing and ensures not only that the roller is lubrified but also that it is suspended inside the housing while being allowed to roll in spite of the absence of a roller pin and is maintained resting against cam 9, without appearance of the usual clinking noise.

This control device has the following advantages:

a very important increase in the bearing surface of the bearing of roller 7 allowing the rocker arm to be loaded very heavily (quick and high rises; high rotation speed);

automatic clearance compensation between cam 9 and roller 7, (without it being necessary to operate with costly and complex hydraulic push rods);

wearless lengthy operation by virtue of the hydrodynamic film which is maintained by rotation of roller 7;

high tolerance on the perpendicularity faults between rocker shaft 3 of rocker arm 2 and its longitudinal direction (hydraulic compensation for the perpendicularity faults).

In describing the Figures, one has heretofore supposed that in the camshaft control device, roller 7 rested on the leading part of a rocker arm 2, but the invention applies as well when roller 7 rests on a tappet 34 having the same alternating motion as the mechanical member 11, as shown diagrammatically in FIG. 8. The elements in this FIG. 8, which are identical with or similar to elements from the preceding Figures are denoted with the same reference numerals and it is therefore sufficient to refer, as far as they are concerned, to the description of these preceding Figures. The only notable differences are that the tappet 34 directly acts on the mechanical member or valve rod 11, and that the oil inlet canal 25 is arranged in the guide 35 of tappet 34 and is linked with the canal 22 as arranged in the tappet 34 through a ring shaped groove 36 arranged at the periphery of tappet 34. The operating mode and advantages of the tappet 34 control device are identical with those of rocker arm 2 control devices or may be easily deduced therefrom by any one skilled in the art.

What is claimed is:

1. A control device, with a camshaft and a roller resting on a tappet or rocker arm, for a mechanical member having an alternating motion, notably for internal combustion engines, made up by a force-transmitting means from a cam of the camshaft to said mechanical member and including a leading part bearing an essentially cylindrical roller which cooperates with the cam of the camshaft and a led part which is rigid with the leading part and cooperates with said mechanical member, said mechanical member moving between two extreme positions of which one corresponds to the maximal displacement of the roller on the cam and the other is determined by a fixed stop on which abuts the mechanical member which is recalled by an elastic return means when the roller cooperates with a downward part of the nose of the cam, the roller swivelling about itself in a recess which is arranged in the leading part and bordered by a circular semi-cylindrical wall and by internal walls of two lateral flanges which are perpendicular to an axis (X—X) of the semi-cylindrical wall, characterized in that:

a pressurized oil inlet communicating with an oil feeding circuit, leads to the semi-cylindrical wall of the recess, preferably near an outmost upstream generatrix of the semi-cylindrical wall, according to the rotational direction of the roller, and the semi-cylindrical wall has a radius (R) which is slightly large than the external radius (r) of the roller, whereas the internal walls of the lateral flanges are separated by a distance (L) which is slightly larger than the width of the roller so as to leave between the roller and the edges of the semi-cylindrical recess and the internal walls of the flanges only an operating clearance which is sufficiently small so that, in operation, the oil from the inlet maintains a hydrodynamic oil film between the roller and the walls of the recess and that a lateral oil leakage is reduced to a minimum.

2. A device according to claim 1, characterized in that the flanges are integral with the leading part.

3. A device according to claim 1, characterized in that the ending of the pressurized oil inlet on the semi-cylindrical wall is made up by a transverse groove arranged along the outmost upstream generatrix.

4. A device according to claim 1, characterized in that a unidirectional means, advantageously made up by a ball check-valve, is interposed in the pressurized oil circuit nearest to the ending thereof on the semi-cylindrical wall.

5. A device according to claim 1, characterized in that the semi-cylindrical wall having the axis (X—X) is lenghtened with two walls which are parallel between them and with the axis (X—X) and tangent respectively to the ends of this semi-cylindrical wall.

6. A device according to claim 1, characterized in that the two ends of the semi-cylindrical wall or the two parallel flanges are lenghtened respectively with tongues the ends of which are separated by a distance which is slightly smaller than the diameter of roller.

7. A device according to claim 1, characterized in that the surfaces in a relative motion, or at least the semi-cylindrical wall are coated with an anti-friction coating, such as, for instance, a cupreous electrolytic deposit.

8. A device according to claim 1, characterized in that between roller and the leading part is interposed a thin semi-cylindrical metal shell made up of an anti-friction material and resting on the semi-cylindrical wall of the recess, a passage for oil being arranged through the shell.

9. A device according to claim 3, characterized in that between roller and the leading part is interposed a thin semi-cylindrical metal shell made up of an anti-friction material and resting on the semi-cylindrical wall of the recess, a passage for oil being arranged through the shell, and in that the transverse groove is arranged in the shell, the passage for oil leading to this groove.

10. A device according to claim 1, characterized in that the roller is hollow and pierced from end to end by an axial hole having a diameter which is sufficiently small to avoid any permanent warping of the roller but sufficiently large to allow the elastic deformation of the roller, due to its contact with the cam.

11. A device according to claim 10, characterized in that the inside diameter (Di) of the hollow roller is in the order of 70% of the external diameter (De) of this roller.

12. A device according to claim 10, characterized in that the inside diameter (Di) of the hollow roller is in the order of 70% of the external diameter (De) of this roller and in that a circular cylindrical spacer, having an external diameter which is smaller than the internal diameter (Di) of the hollow roller, is arranged along the axis (X—X) of the semi-cylindrical wall rigid with the two lateral flanges.

13. A device according to claim 1, characterized in that said force-transmitting means is made up by a tappet undergoing the same alternating motion at least approximately in a straight line, than said mechanical member.

14. A device according to claim 1, characterized in that said force-transmitting means is made up by a rocker arm oscillating about a rocker shaft which is parallel with the geometrical axis (X—X) of the roller.

15. A device according to claim 14, characterized in that said pressurized oil inlet is essentially made up by a canal which is arranged in the body of rocker arm and communicates with the oil feeding circuit through a peripheral groove on the rocker shaft, a radial passage arranged in the rocker shaft and a canal longitudinally pierced in the rocker shaft.

* * * * *